US005671851A

United States Patent [19]

Johnson et al.

[11] Patent Number: 5,671,851

[45] Date of Patent: Sep. 30, 1997

[54] PRODUCT DISPLAY APPARATUS

[75] Inventors: Terry Johnson, Chicago; Randy L. Johnson, Lake Forest, both of Ill.

[73] Assignee: Gamon International, Inc., Elk Grove Villages, Ill.

[21] Appl. No.: 643,084

[22] Filed: May 2, 1996

[51] Int. Cl.[6] ..... A47F 1/00; A47F 10/02

[52] U.S. Cl. ..... 211/51; 211/54.1; 211/57.1; 211/59.1; 211/59.2; 211/59.3; 211/106; 248/220.21; 248/220.31

[58] Field of Search ..... 211/54.1, 51, 57.1, 211/59.1, 106, 59.3, 59.2; 248/220.21, 220.31, 220.41, 220.42

[56] References Cited

U.S. PATENT DOCUMENTS

| | | | |
|---|---|---|---|
| 3,161,295 | 12/1964 | Chesley | 211/59.3 |
| 4,286,764 | 9/1981 | Pfeifer | 248/220.31 X |
| 4,475,658 | 10/1984 | Roberts | 211/54.1 |
| 4,821,894 | 4/1989 | Dechirot | 211/54.1 X |
| 4,869,379 | 9/1989 | Valiulis et al. | 211/54.1 X |
| 5,009,334 | 4/1991 | Bodkins | 211/54.1 |
| 5,114,021 | 5/1992 | Fredrickson | 211/54.1 |
| 5,222,608 | 6/1993 | Eklof et al. | 211/54.1 |

*Primary Examiner*—Leslie A. Braun
*Assistant Examiner*—Donald J. Wallace
*Attorney, Agent, or Firm*—Douglas B. White

[57] ABSTRACT

This product display apparatus includes a moveable backing plate arranged to ride on a mounting rod behind product suspended from a parallel display rod, and employs a coil spring bias to urge the backing plate forwardly. The backing plate includes an engaging hook to extend through a slot and to catch onto a locking edge for holding the plate at the rear while the display is loaded. A close tolerance mounting hole on the plate and a narrow slot forming the locking edge constrains an operator to unload packages from the display rod before restocking.

13 Claims, 3 Drawing Sheets

FIG. 3a
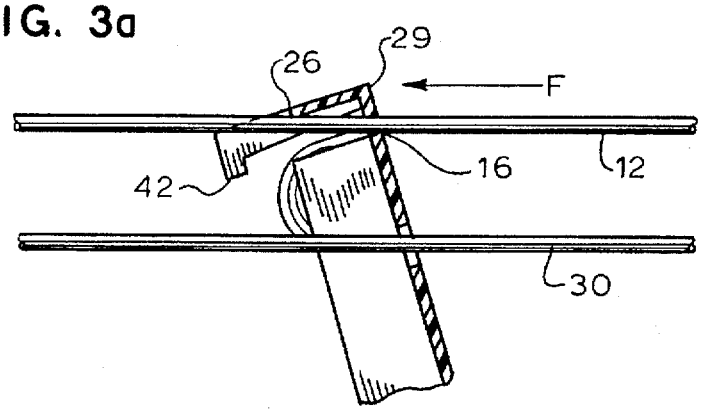
FIG. 3b
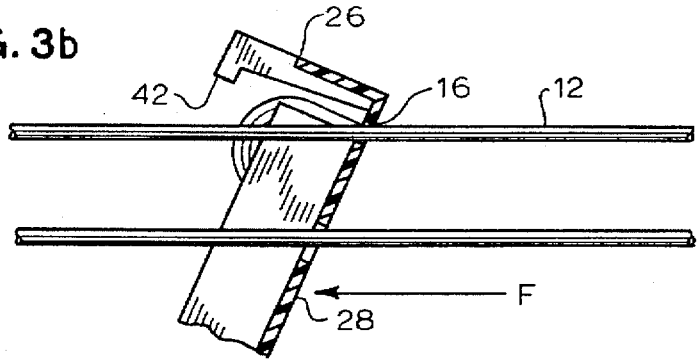
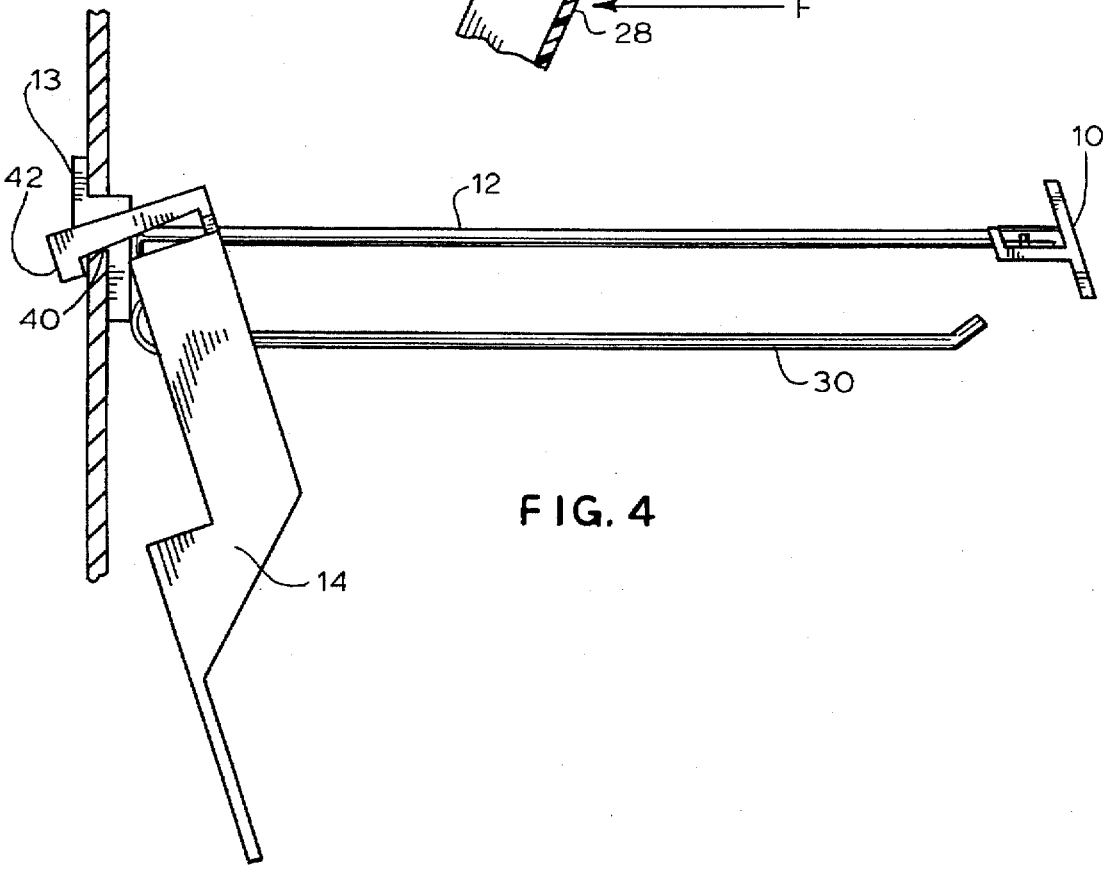
FIG. 4

PRODUCT DISPLAY APPARATUS

BACKGROUND OF THE INVENTION

1. Field of the Invention

The invention relates generally to product displays, and more particularly it relates to a display designed to maintain a stack of packaged product suspended on a projecting rod and to present it at the forward end thereof.

2. Description of the Prior Art

Product display apparatus employing a projecting rod or wire (sometimes referred to as a peg bar system) for the suspension of packaged products such as food, is well known and is currently in general use. However, when store personnel restock supplies of packaged food, they frequently push old stock to the back and place the fresh stock in front, frustrating store efforts to rotate stock. To date no apparatus has been presented to assist store management in achieving effective stock rotation with rod suspended food packages.

SUMMARY OF THE INVENTION

Accordingly, it is the principal objective of the present invention to provide a product display of the projecting rod type which is easy to load and yet promotes rotation of inventory.

The display apparatus of the present invention includes a moveable plate arranged to ride on a horizontally projecting mounting rod under a coil spring bias, to maintain a stack of suspended packaged product at the forward end of a horizontally projecting display rod. At the rear of the display, the moveable plate selectively engages a narrow slot to hold the plate at the rear while the display is loaded. Since the moveable plate is mounted to the projecting rod via a close fitting hole, the plate must remain substantially vertically aligned to slide easily along the horizontal rod; and exact manual manipulation is required to successfully engage the rear catch. Due to the changes in the spring force during the spring uncoiling, coupled with the close tolerance of the plate mounting hole on the rod and the narrow slot catch, movement of the plate and engagement of the catch is made extremely difficult unless suspended packages are first removed from in front of the plate.

BRIEF DESCRIPTION OF THE DRAWINGS

FIGS. 3*a* and 3*b* are side views of the apparatus.

FIG. 4 is a side view of the apparatus with the plate fully rearward and latched.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
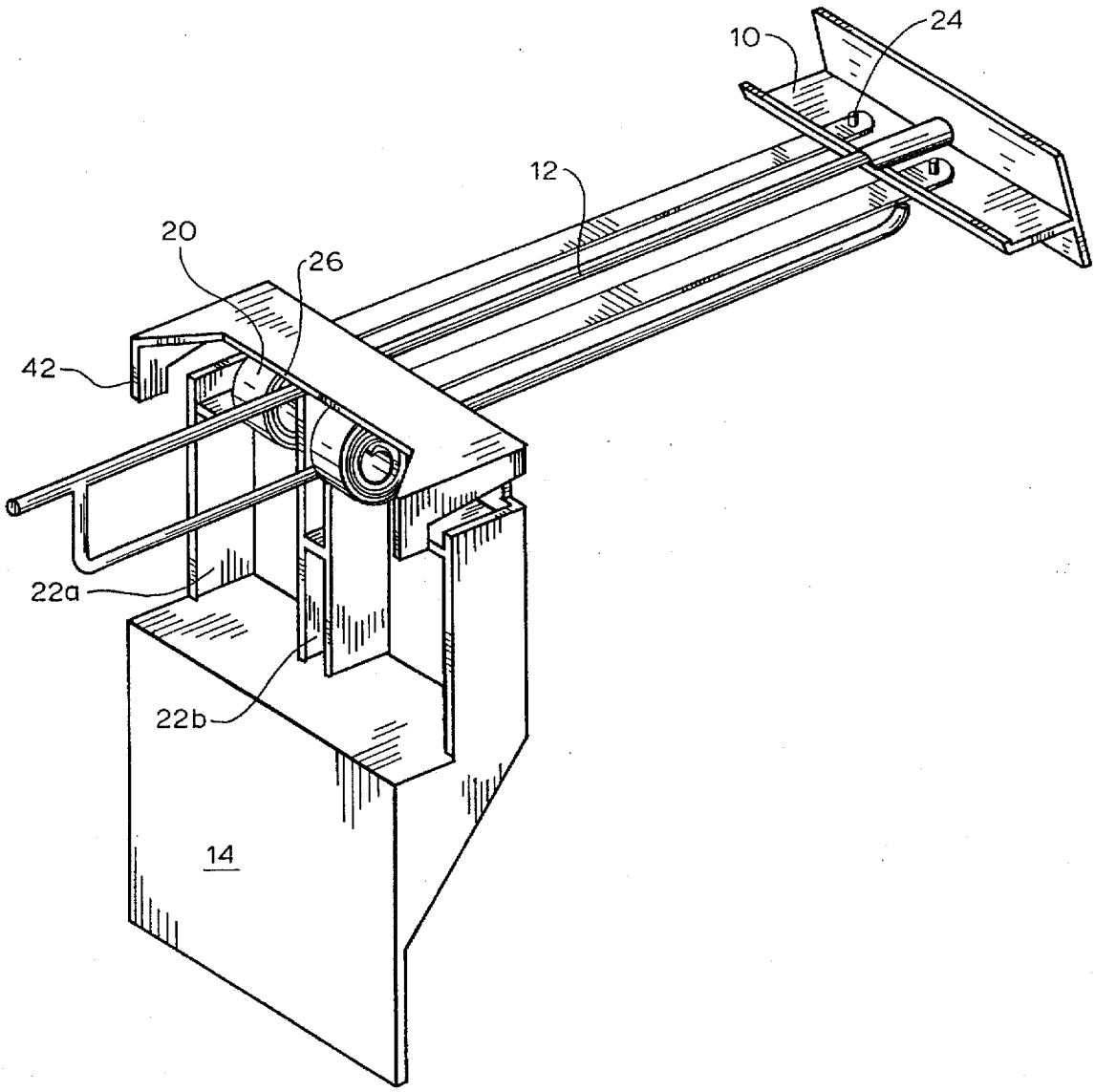
FIG. 1 is a perspective view of the forward portion of the product display apparatus of the present invention, viewed from a rear angle.
Figure 2:
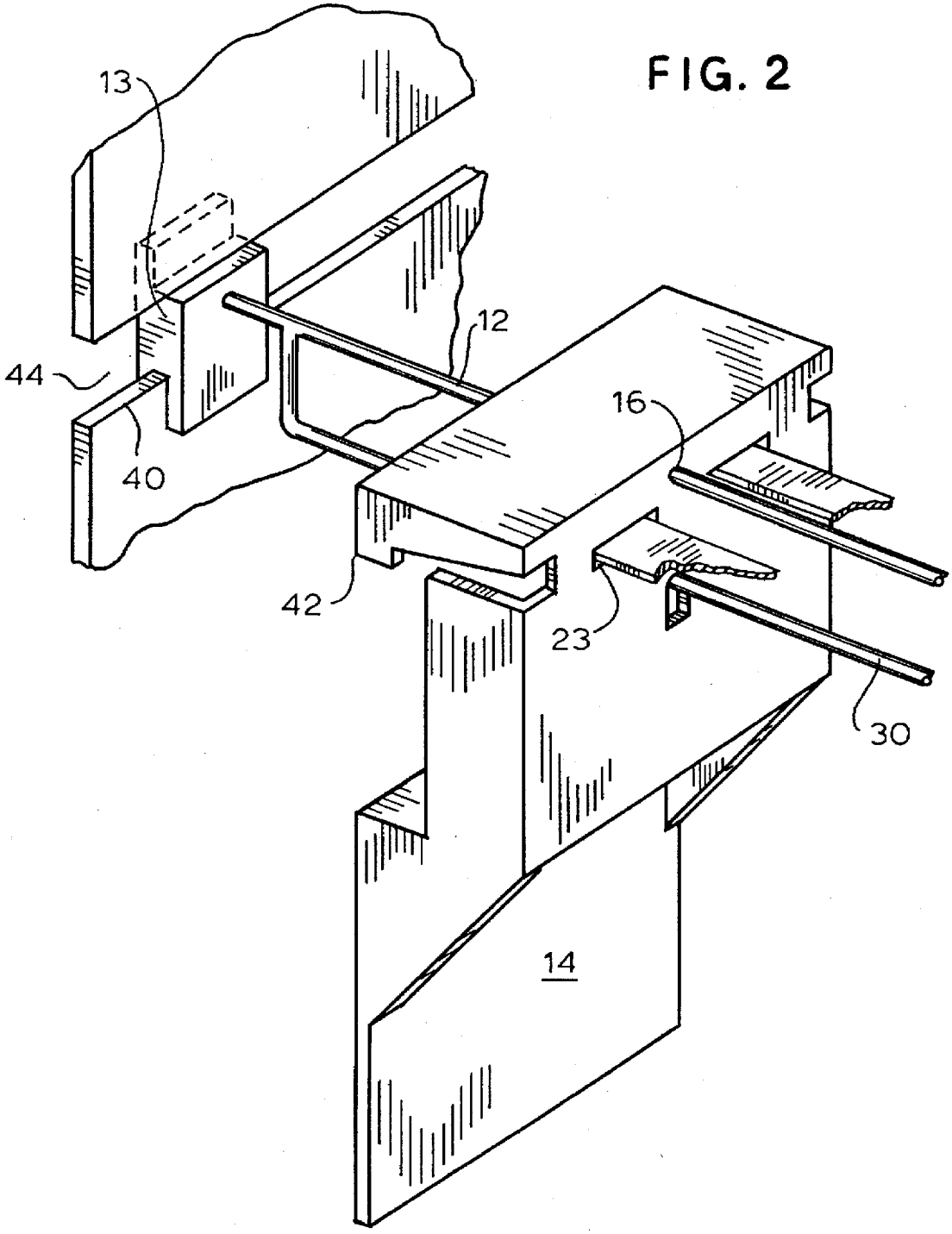
FIG. 2 is a perspective view of the rearward portion of the product display apparatus of FIG. 1, viewed from the front.

Turning to the figures, there is shown a display apparatus in accordance with the present invention. This apparatus employs an anchor member 10 (FIG. 1) attached to the forward end of a horizontally projecting mounting rod 12, and a mounting base 13 (FIG. 2) affixed to the rearward end of the mounting rod to cantilever the apparatus from a wall support. A moveable backing plate 14 is suspended on the projecting mounting rod 12 via a close fitting hole 16 (FIG. 2) for controlling packages (not shown) suspended in front thereof.

To urge the plate towards the front of the display, coiled springs 20 are constrained between vertical supports 22*a* and 22*b* behind the backing plate. These coil springs comprise coiled metal bands with one end of each of the coils extending through openings 23 in the moveable backing plate to attachments 24 on the front anchor member 10. As a result, the forward force exerted by the springs increases as the plate is moved rearwardly, and is applied to the plate at a location below the openings 23 by a changing distance equal to the changing radius of the coil.

When displaying product, packages are positioned forward of the moveable backing plate and suspended on a protruding display rod 30 mounted below and parallel to the mounting rod 12. The coil springs, through their coiling action against the plate, then urge the stack of packages forwardly on the display rod towards the front of the display where the forward most package catches on the up-turned end of the display rod. Removal of a package from the front will then automatically result in a forward shift of the remainder of the stack.

To encourage stock rotation, certain operational control features of the present invention prevent smooth rearward movement as well as rear latching of the backing plate unless carefully controlled rearward pressure is applied to the plate. This requires the operator to first remove old stock when loading the display to effect rearward movement and latching of the plate.

Turning to FIGS. 3*a* and 3*b*, the first operational control feature is depicted. To avoid a frictional seizure of the mounting hole 16 of the plate with its horizontal supporting rod 12, the moveable plate needs to be substantially vertically aligned during movement along the horizontal supporting rod. This alignment is assisted by an overhanging edge 26 on the rear of the moveable plate which limits rotation in one direction (in the counter-clockwise direction as shown in FIGS. 3*a* and 3*b*) and prevents the frictional seizure with the mounting rod when rotated off of vertical in that direction; but no such limit is provided to prevent seizure in the other rotational direction. Consequently, if a typical rearwardly directed force is applied to the plate at a location 28 below the coil spring point of application, the plate rotates slightly (clockwise in FIG. 3*b*) and frictionally grabs the rod, preventing the operator from loading the display. In contrast, during the normal return of the plate to the front under spring force, such a locking rotation of the plate is prevented (FIG. 3*a*) by the overhanging edge 26 of the plate.

As a second operational control feature, a locking edge 40 (FIG. 2) extends laterally from the base member and is engageable by the rearwardly protruding latching hooks 42 of the backing plate 14. In the preferred embodiment this locking edge is presented in the form of one side of a narrow slot 44 (FIG. 2) to which the mounting base is attached for support and through which the latching hooks must be carefully passed to successfully catch the locking edge (FIG. 4). This latching operation is easily accomplished when the display is empty and the plate is pushed directly by hand, as the location and magnitude of the spring force are readily discovered and the erratic rotational tendency of the moveable plate is then easily controlled. However, when a stack of packages is left suspended in front of the plate and the rearward force is applied to the stack, successful control of the plate becomes virtually impossible due to the interference of the packages and the instability of the stack.

With the plate hooks engaged to the locking edge, the operator can now easily load packages onto the display rod, placing the old stock in front. After loading the stack of packages, rearward pressure applied to the stack of packages causes the backing plate to rotate. This causes the latching hooks of the backing plate to rise sufficiently to release the locking edge and, under the spring force, to withdraw from the slot.

From the foregoing description, it will be apparent that modifications can be made to the apparatus and method for using same without departing from the teachings of the present invention. Accordingly, the scope of the invention is only to be limited as necessitated by the accompanying claims.

What is claimed is:

1. A product display apparatus for presenting a stack of inventory comprising:

a base member having a mounting rod and a product suspension display rod attached thereto and projecting in parallel forwardly therefrom;

a movable plate member slidably engaged with said mounting rod for providing a forward bias to a stack of inventory suspended on said display rod;

means for urging said moveable plate member forwardly; and latch means for selectively latching said movable plate member proximate said base member, said latch means being operable through manipulation of said movable plate member.

2. The product display apparatus of claim 1 wherein said latch means for selectively latching said movable plate member comprises a locking edge proximate said base member and a hook member protruding rearwardly from said plate member for engaging said locking edge.

3. The product display apparatus of claim 2 wherein said locking edge is comprised of one edge of a narrow slot proximate said base member.

4. The product display apparatus of claim 3 wherein said base member is attached to said slot.

5. The product display apparatus of claim 1 wherein said engagement of said movable plate member with said mounting rod comprises a close fitting mounting hole for suspending said movable plate member on said mounting rod, wherein said mounting hole of said movable plate member frictionally seizes said mounting rod unless said movable plate member is maintained substantially perpendicular thereto.

6. The product display apparatus of claim 5 wherein said means for selectively latching said movable plate member comprises a locking edge proximate said base member and a hook member protruding rearwardly from said plate member for engaging said locking edge.

7. The product display apparatus of claim 6 wherein said locking edge is comprised of one edge of a narrow slot proximate said base member.

8. The product display apparatus of claim 7 wherein said base member is attached to said slot.

9. The product display apparatus of claim 5 wherein said means for urging said movable plate member forwardly comprises an anchor member mounted to the forward end of said mounting rod and coil spring means attached to said anchor member and coiled behind said movable plate member.

10. The product display apparatus of claim 9 wherein said movable plate member further comprises limiting means to prevent said plate member from seizing said mounting rod during forward movement under said coil spring bias.

11. The product display apparatus of claim 10 wherein said latch means for selectively latching said movable plate member comprises a locking edge proximate said base member and dual hook members protruding rearwardly from said plate member for engaging said locking edge.

12. The product display apparatus of claim 11 wherein said locking edge is comprised of one edge of a narrow slot proximate said base member.

13. The product display apparatus of claim 12 wherein said base member is attached to said slot and said slot extends laterally from said base member.

* * * * *